United States Patent [19]

Carter

[11] 4,258,910

[45] Mar. 31, 1981

[54] FLEXIBLE FOOT EXTENDER

[76] Inventor: John R. Carter, 3 Myrtle Ave., North Plainfield, N.J. 07060

[21] Appl. No.: 945,329

[22] Filed: Sep. 25, 1978

[51] Int. Cl.[3] ..... A63B 71/00

[52] U.S. Cl. ..... 272/1 R; 273/DIG. 18; 272/93

[58] Field of Search ..... 272/8 R, 94, 96, 97, 272/1 R, 25, 21, 70, 93, 114, 125, 126, 127, 137, 138, 139, 142; 273/67 B, DIG. 18, 1 R; 36/102, 112, 136, 139, 116, 122; 280/600, 601, 609; D21/224, 228, 229; 9/310 A, 310 D, 310 F

[56] References Cited

U.S. PATENT DOCUMENTS

| | | | |
|---|---|---|---|
| 1,671,096 | 5/1928 | Anderson | 272/70 X |
| 2,932,910 | 4/1960 | Brown | 36/122 |
| 3,123,373 | 3/1964 | Antcliff | 9/310 F X |
| 3,488,049 | 1/1970 | Sasser | 272/1 R |
| 3,501,144 | 3/1970 | Schmidt | 273/1 R |
| 3,655,211 | 4/1972 | Bollettieri et al. | 280/609 |

FOREIGN PATENT DOCUMENTS

| | | | |
|---|---|---|---|
| 828703 | 2/1938 | France | 280/609 |
| 111378 | 8/1925 | Switzerland | 272/96 |
| 125752 | 5/1928 | Switzerland | 280/601 |
| 191871 | 7/1937 | Switzerland | 280/601 |

OTHER PUBLICATIONS

*How to Make It, Book of Crafts,* C. Sprague, 1st Edition, N.Y., Bridgman Publisher Inc., 1941, pp. 172–173.

*Primary Examiner*—Richard C. Pinkham
*Assistant Examiner*—Arnold W. Kramer
*Attorney, Agent, or Firm*—Kenyon & Kenyon

[57] ABSTRACT

A flexible extender adapted to being worn on the foot is disclosed. The foot extender according to the invention extends forwardly of the wearer for substantially its entire length. In accordance with the preferred embodiment, the foot extender comprises an elongated flexible base portion, a platform portion adapted to receive a shoe, and heel and toe straps to secure the extender to the foot of the wearer. The foot extender provides magnification of the foot's movement and power and is utilizable for creative encounters between the wearers, for dance or exercise, as an educational implement and as a creative plaything, to name a few.

18 Claims, 7 Drawing Figures

FLEXIBLE FOOT EXTENDER

FIELD OF THE INVENTION

The present invention relates to a novelty item and more particularly to a flexible extender adapted to being worn on the foot.

SUMMARY OF THE INVENTION

In accordance with the present invention, a flexible, elongated extender is provided. An elongated extender is secured on each foot of the wearer adjacent one end of the extender, and extends forwardly of the wearer. The extenders tend to provide magnification of the foot's movement and power. In addition to the magnifying effect of the extenders, they also possess their own innate movement and flexure characteristics, such as, for example, flapping or waving, or being curved in an arc pointed upwardly (concave) or downwardly (convex) which provides a substantially different effect than pointing the foot upwardly or downwardly. Thus, the extenders are useful in creating surrealistic fantasies and formalistic graphic or sculptural designs.

It is contemplated that the extenders according to the invention be utilized in many ways. For example, the elongated foot extenders may be used as a medium for creative encounters by individuals wearing them in which the individuals interact with one another via the extenders, for example, in a dance, game or group exercise. The extenders may be used to form three dimensional and planar configurations. In forming the configurations, a degree of cooperation and coordination of the individuals wearing the extenders is required. The configurations attainable are limited only by the imagination of the wearers. Additionally, the extenders according to the invention also find use as creative play things for children and adults, and may be used in dance and movement and may be used as an exercise device in, for example, dance movement, exercise, coordination and balance training, particularly in dance classes, gymnastics and/or other physical training classes. The extenders may also be employed as a teaching aid. Moreover, the extenders, which may be multicolored, may provide visual entertainment through, for example, colorful geometric floor patterns or weavings and sculptural shapes such as, for example, tangential arcs, enclosures and other structures.

When used for creative encounters, celebration and social interaction by individuals, the extenders may tend to reduce the social inhibitions of the individuals wearing them for many reasons. Because the activity is unprecedented, the wearer's expectations of how to do well and subsequent self-criticism are reduced. Wearers will recognize the comical nature of the extenders and the partial unpredictability of their use, and tend not to take themselves so seriously. Additionally, whereas direct contact between participants, particularly between strangers in a movement game or exercise, might be too intimate, the indirectness of the interface between wearers further may reduce inhibitions. In the use of foot extenders, normal or usual foot movement is difficult while extraordinary movement is easy and unavoidable.

The extenders are capable of generating noise upon flapping thereof, particularly upon striking the floor or ground, or other extenders, and this enhances the utility of the extenders. For example, the extenders may be used in a foot percussion which is a magnification of foot tapping; a wave-like motion is generated outwardly from the foot to the tip of the extender to thereby increase the intensity of the sound as the tip strikes the floor. Thus, the wearer has the illusion of having giant feet, which may be exhilarating, frightening, etc.

Each extender comprises an elongated flexible base portion having a top and opposed ends, and means for securing the extender to the foot of the wearer. Means are also disposed on the top of the base portion adjacent one end thereof for receiving the foot of the wearer. The base portion is of a length which is sufficient to permit substantial transverse flexing of the extender along the length thereof. Preferably, the length of the extender (base portion) is at least about eight times its width.

According to a preferred embodiment, the means for receiving the wearer's foot comprises a platform portion having a length which is a minor fraction of the length of the base portion so that flexing of the base portion is substantially unimpeded by the platform portion. Preferably, the length of the base portion is at least about three times the length of the platform portion. The platform portion is adapted to receive the foot of the wearer and the means for securing the extender are disclosed to be strap means which extend around the foot of the wearer to strap the extender to the foot. The platform portion is secured to the base portion adjacent one end thereof so that substantially the entire length of the extender extends forward of the wearer when the extender is strapped to his foot.

The strap means comprises a heel strap extending from adjacent the end of the platform portion which is adjacent one end of the base portion and a toe strap which is secured to the platform portion and extends from adjacent the other end of the platform portion which is located forwardly from the end of the base portion.

The platform portion is preferably made of a resilient material and, in cooperation with the strap means, is preferably adapted to receive the shoe of the wearer. The toe strap includes two strap ends which have locking means attached thereto and the heel strap includes two heel strap ends and a cross strap secured thereto with the ends of the cross strap having locking means attached thereto. The ends of the toe strap may be locked over the toe of the shoe and the ends of the cross strap may be locked about the ankle of the wearer, or alternatively, one toe strap may be locked with one end of the cross strap extending over the foot instep, and the other toe strap is locked with the other end of the cross strap also extending over the instep, the locked extending portions being crossed over the instep.

It is also contemplated according to the invention that means for receiving the foot of the wearer encompass embodiments other than a platform and may comprise, for example, a receptacle in the base portion. The receptacle may be formed by a lip, ridge or recess extending in or about one end of the base portion.

It is additionally contemplated in accordance with the invention that the means for securing the extender to the foot encompass embodiments other than straps such as, for example, a snap-fit or step-in arrangement.

These and other aspects of the invention will be more apparent from the following description of the preferred embodiment thereof when considered with the accompanying drawings and appended claims.

BRIEF DESCRIPTION OF THE DRAWINGS

The present invention is illustrated by way of example and not limitation in the figures of the accompanying drawings in which like references indicate similar parts and in which.

DESCRIPTION OF THE PREFERRED EMBODIMENT

Figures 1, 2, 3, 4, 5, 6, 7:
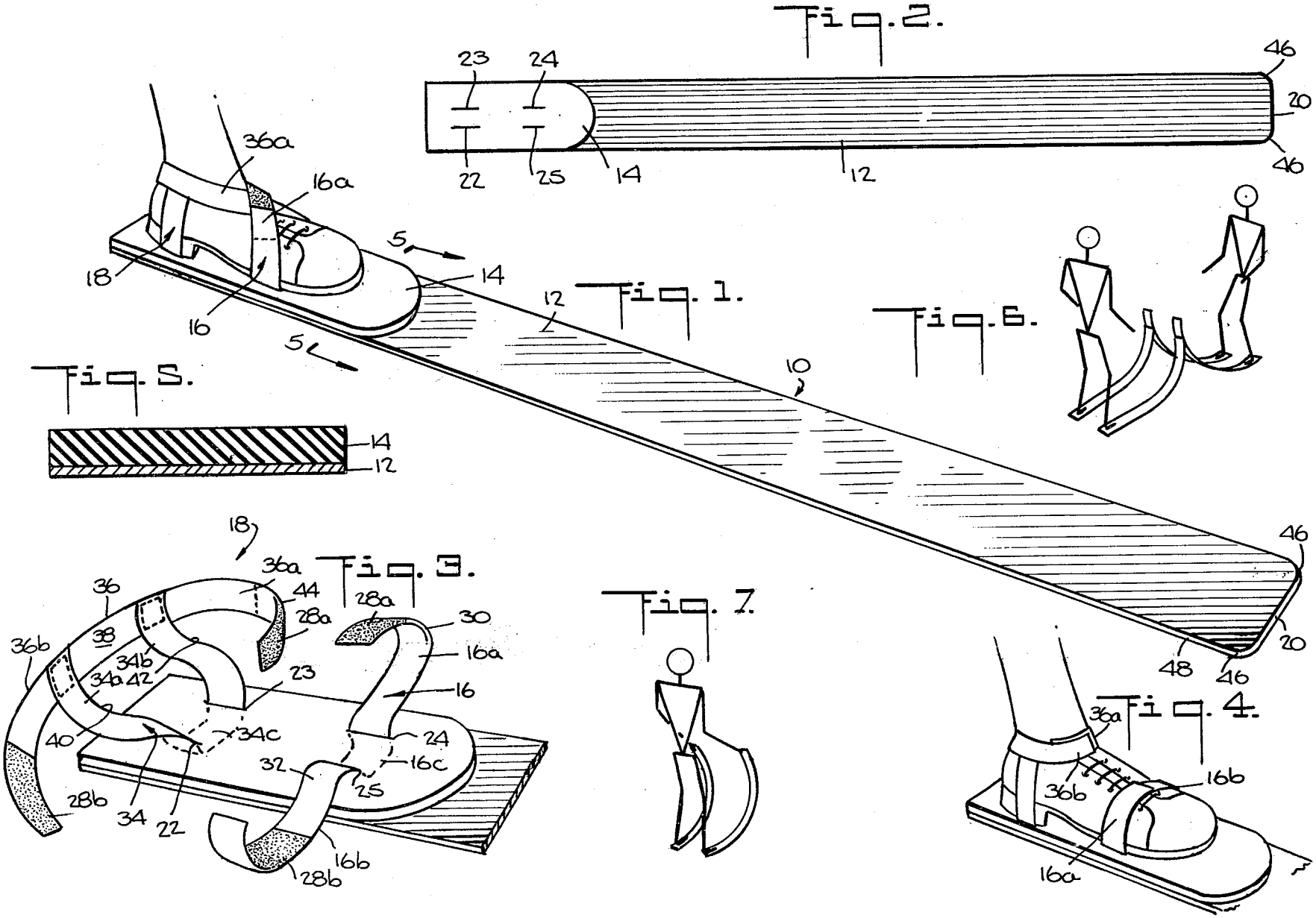
FIG. 1 is a top perspective view of the foot extender according to the invention showing the extender strapped on a foot.
FIG. 2 is a top view of the extender of FIG. 1 with the heel and toe straps removed.
FIG. 3 is an enlarged perspective view of a portion of the extender of FIG. 1 showing the platform portion and the heel and toe straps.
FIG. 4 is a top perspective view of a portion of the extender of FIG. 1 showing the extender strapped to a foot in a manner differing from that shown in FIG. 1.
FIG. 5 is a cross-sectional view taken along lines 5—5 of FIG. 1.
FIGS. 6 and 7 are schematic views showing the extenders according to the invention being worn and utilized in different manners.

Referring more particularly now to the drawings, the extender 10 is illustrated and includes an elongated base member 12, a platform member 14, a toe strap 16 and a heel strap 18. The base member is flexible so that it may be flexed upwards to a substantial degree along the length of the extender as shown, for example, in FIG. 7. However, the base member is sufficiently self-supporting so that when suspended horizontally, the free end 20 thereof may sag but the extender is supported substantially horizontally. A preferred, flexible but self-supporting material for the base member is plexiglass. It is contemplated that other flexible, self-supporting materials may also be used for the base member, for example, fiberglass, plastic or rubber (particularly a foam) and other flexible, self-supporting materials.

The platform 14 is adapted to receive the shoe of the wearer and is accordingly of a length greater than a large shoe size. Elongated space slits 22–25 (FIGS. 2 and 3) are provided through the platform member for the heel and toe straps. The toe strap is made of a single strap (FIG. 3) which extends into slit 24 of the platform member, and then extends out of slit 25. Strap 16 has two free ends 16*a* and 16*b* extending from the platform. Ends 16*a,b* include mating parts of a pile lock, for example, mating Velcro material. On end 16*a*, Velcro material 28*a* is secured to side 30 of the strap end which faces outwardly and on end 16*b*, mating Velcro material 28*b* is secured to side 32 of the strap end which faces inwardly. The heel strap 18 includes a heel strap member 34 extending through slits 22, 23 as described for strap 16 and slits 24, 25 and a cross-strap 36 secured to the free ends 34*a*,34*b* of strap 34. Side 38 of strap 36 is secured to the sides 40,42 of strap ends 34*a*,34*b*, respectively, which face outwardly. The ends 36*a*,36*b* of the cross-strap have Velcro material secured thereto, Velcro material 28*a* being secured to the outer side 44 of end 36*a* Velcro material 28*b* being secured to the inner side 38 of end 36*b*.

The platform 14 with the straps extending therefrom is secured to the top of the base member 12 by an adhesive, for example. The platform member is a minor fraction of the length of the base member and accordingly has little or no effect upon the flexibility of the base member as a whole. The platform member is resilient and provides cushioning to the foot of the wearer and is preferably made of rubber. However, the platform member may be made from other resilient materials. Preferably, cement or adhesive is used to secure a rubber platform member to the base member. Alternatively, the platform portion could be part of the base member, i.e., forming one piece with the base member.

When the platform member is secured to the base member, strap portions 16*c* and 34*c* are sandwiched between the platform and base members and secured to the extender thereby.

Slits 22 and 23, and slits 24 and 25 are respectively parallel to each other, and are spaced by a distance which is less than the width of a large shoe size, i.e., less than about two inches. Thus, when a shoe is placed on the platform member, part of straps 16*a,b* will be between the toe of the wearer's shoe and the platform, and part of straps 34*a,b* will be between the heel and the platform. This arrangement ensures that the extender is securely strapped to the shoe and reduces substantially side movement of the shoe on the platform member.

As shown in FIG. 1, a shoe is strapped onto the platform member by a crossing arrangement in which Velcro material 28*a* on toe end 16*a* is locked with Velcro material 28*b* on heel cross-strap end 36*b*, and Velcro material 28*b* on toe end 16*b* is locked with Velcro material 28*a* on heel cross-strap end 36*a*. In this crossing arrangement, the straps rum from under the shoe and from the toe to heel, crossing the instep, and the extender is snugly secured to the shoe and ankle of the wearer. In FIG. 4, strap ends 16*a*,16*b* are locked across the toe of the shoe and cross-strap ends 36*a*,36*b* are locked about the ankle of the wearer. This arrangement also snugly secures the extender to the shoe.

The platform portion, in addition to providing a resilient platform for a shoe, can also perform a safety function. The platform portions of the extenders serve to offset the shoe of the wearer from the base portion so that when a wearer's extenders cross, the base of one extender will not strike the wearer's foot on the other extender, but instead will strike the offset platform. Alternatively, the base portions themselves can be made of a resilient material.

In accordance with a preferred embodiment the base member can be about 60 inches long, about 5 inches wide and about $\frac{1}{8}$ inch thick, and the platform member about 12 inches long, about 5 inches wide and about $\frac{1}{2}$ inch thick. Additionally, the heel slits can be located $1\frac{3}{4}$ inches from the end of the platform and extend for about 2 inches; the toe slits can be located about $6\frac{1}{4}$ inches from the end of the platform and extend for about 2 inches, and opposed slits can be spaced by about $1\frac{1}{2}$ inches.

The extenders may be utilized in many ways. For example, as a medium for creative encounter, individuals wearing the extenders interact with one another to form three-dimensional configurations (FIG. 6) or planar configurations. To obtain the configuration shown in FIG. 6, the wearers must maneuver the extenders so that the extender ends come into contact bottom-to-bottom while they are flexed. When the wearer's toes are lifted and dropped simultaneously, the extender tips of facing wearers are caused to move back and forth alternately towards one wearer and then the other to create a kinetic sculptural happening. Additionally, a degree of dexterity is required of each wearer as well as the cooperation of the wearers.

In the configuration of the extender shown in FIG. 7, a wearer has grasped the end of each extender so that the ends are flexed substantially vertically. To obtain this configuration, the wearer must lift each foot individually and flap the extender to flex it sufficiently for him to grasp its end. This also requires a degree of dexterity on the part of the wearer. To obtain the illustrated configurations, the extenders must be flexible and exhibit a degree of strength to withstand the forces generated while attempting to obtain the flexed configurations or when unflexing or striking the floor or each other.

The ends 20 of the extenders are preferably planar, as planar ends enhance the geometric configurations formed by the extenders. Additionally, planar ends with rounded corners 46 reduce risk of injury, particularly when the extenders are used by children. For this reason also, the edges 48 of the extenders are also rounded.

While two configurations of use of the extenders have been illustrated in FIGS. 6 and 7, many more configurations are possible. For example, wearers may face each other, as in FIG. 6 but in a sitting position with their extenders in a contracting, flexed configuration as in FIG. 6. While sitting, each wearer may also move his extenders from side to side. Other configurations and uses for the extenders are limited only by the imagination of the users.

In accordance with the invention, the extenders may be utilized for many purposes as pointed out hereinbefore.

The advantages of the present invention, as well as certain changes and modifications of the disclosed embodiment thereof, will be readily apparent to those skilled in the art. It is the applicant's invention to cover by his claims all those changes and modifications which could be made to the embodiment of the invention wherein chosen for the purposes of the disclosure without departing from the spirit and scope of the invention.

What is claimed is:

1. A flexible extender adapted to being worn on the foot and tending to provide magnification of the foot's movement and power and particularly utilizable for creative encounters between the wearers, for dance or exercise, as an educational implement, as a creative plaything, and as a novelty item, said extender comprising an elongated, essentially flat base portion with a substantially flat forward end and having a top and opposed ends and means adjacent one end of the base portion for securing the extender to the foot of the wearer, said base portion being flexible substantially along its entire length in opposed directions in a plane extending generally perpendicular to the plane of top of the base portion, said base portion being capable of being flexed in each of said opposed directions, said base portion being made of a material such that said base portion can be repeatedly flexed without fracturing, said base portion having a length, being of a thickness and being sufficiently flexible such that when the base portion is supported at said one end thereof generally in a horizontal plane, the base portion extending from said one end flexes under its own weight and slopes downwardly and in such supported position the forward end may be flexed substantially vertically.

2. The extender as recited in claim 1, and further comprising means disposed on the base portion adjacent the one end for receiving the foot of the wearer.

3. The extender as recited in claim 2, wherein the means for receiving the foot of the wearer comprises a platform portion having a top and opposed ends and being adapted to receive the foot of the wearer on the top thereof, the platform portion being secured to the base portion and extending along the top thereof from adjacent the one end thereof, the platform portion being of a length which is a minor fraction of the length of the base portion whereby said flexing of the base portion is substantially unimpeded by the platform portion.

4. The extender as recited in claim 3, wherein the platform portion extends above the base portion and is adapted to receive the foot of the wearer and raise it above the base portion.

5. The extender as recited in claim 3, wherein said means for securing the extender comprises a heel strap secured to the platform portion extending from adjacent one end thereof which is adjacent to the one end of the base portion and a toe strap secured to the platform section and extending from adjacent another end thereof which is located along the length of the base portion.

6. The extender as recited in claim 5, wherein the toe strap includes two toe strap ends extending from the central part of the platform portion, the toe strap ends being spaced as they extend from the platform portion by a distance of less than about two inches.

7. The extender as recited in claim 6, wherein each to strap end includes a mating part of a pile lock.

8. The extender as recited in claim 7, wherein the platform portion is adapted to receive the shoe of the wearer and the toe and heel straps are strapped about the shoe and ankle of the wearer to strap the extender to the foot of the wearer.

9. The extender as recited in claims 5 or 7, wherein the heel strap includes two heel strap ends extending from the central part of the platform, the heel strap ends being spaced as they extend from the platform portion by a distance of less than about two inches, the heel strap also including a cross-strap secured to the ends of the heel strap and extending transversely thereto.

10. The extender as recited in claim 9, wherein the cross-strap includes mating parts of a pile lock on the respective ends thereof.

11. The extender as recited in claim 10, wherein like parts of the pile lock are located on the strap ends on the same side of the extender.

12. The extender as recited in claim 3, wherein the other end of the base portion has a transverse, planar edge in the central portion thereof.

13. The extender as recited in claim 3, wherein the platform portion is made of a resilient material.

14. The extender as recited in claim 13, wherein the platform portion is made of a rubber material.

15. The extender as recited in claim 3, wherein the length of the base portion is at least about four times the length of the platform portion.

16. The extender as recited in claims 1 or 3, wherein the base portion is made of a flexible plastic material.

17. The extender as recited in claim 16, wherein the base portion is made from a material chosen from the group consisting of plexiglass, rubber foam, plastic foam and fiberglass.

18. The extender as recite in claim 1, wherein the length of the base portion is at least about eight times the width of the base portion.

* * * * *